US008220479B1

(12) United States Patent
Mayeaux

(10) Patent No.: US 8,220,479 B1
(45) Date of Patent: Jul. 17, 2012

(54) MULTI-STAGE RATIO PRESSURE REGULATOR SYSTEM

(75) Inventor: Donald P. Mayeaux, St Amant, LA (US)

(73) Assignee: A+ Manufacturing LLC, Gonzales, LA (US)

( * ) Notice: Subject to any disclaimer, the term of this patent is extended or adjusted under 35 U.S.C. 154(b) by 945 days.

(21) Appl. No.: 12/131,987

(22) Filed: Jun. 3, 2008

(51) Int. Cl.
*F17D 1/00* (2006.01)

(52) U.S. Cl. ..... 137/12; 137/505.12; 137/505.25; 137/613; 137/906

(58) Field of Classification Search ..... 137/505.12, 137/505.15, 505.25, 505.28, 115.13, 484.2, 137/494, 12, 14, 613, 508, 505.14, 906
See application file for complete search history.

(56) References Cited

U.S. PATENT DOCUMENTS

| | | | | |
|---|---|---|---|---|
| 3,545,485 | A * | 12/1970 | Clark | 137/508 |
| 4,566,488 | A * | 1/1986 | Chow et al. | 137/613 |
| 4,802,507 | A * | 2/1989 | Willson | 137/613 |
| 5,520,206 | A * | 5/1996 | Deville | 137/12 |
| 6,152,158 | A * | 11/2000 | Hu | 137/14 |
| 6,959,724 | B2 * | 11/2005 | Heiderman | 137/494 |
| 7,048,000 | B2 * | 5/2006 | Koelzer | 137/505.25 |
| 7,314,059 | B2 * | 1/2008 | Schuetze et al. | 137/487.5 |
| 7,565,911 | B2 * | 7/2009 | Bonta, Jr. | 137/14 |

* cited by examiner

*Primary Examiner* — John Rivell
*Assistant Examiner* — Minh Le
(74) *Attorney, Agent, or Firm* — Joseph T Regard, Ltd plc

(57) ABSTRACT

A multi-stage pressure regulator in which pressure is first reduced by a set ratio in one or more stages followed by an adjustable pressure output stage. The system of the present invention provides for distribution of the Joules-Thomson (JT) cooling effect between multiple stages. The present invention thereby provides a system to control pressure reduction and thus prevent condensation (and associated distortion of a vapor composition sample) of a gas due to J-T cooling effect.

14 Claims, 9 Drawing Sheets

MULTI-STAGE RATIO PRESSURE REGULATOR SYSTEM

TECHNICAL FIELD OF INVENTION

The present invention relates to a multi-stage pressure regulator in which pressure is first reduced by a set ratio in one or more stages followed by an adjustable pressure output stage. This technique provides for distribution of the Joules-Thomson (JT) cooling effect between multiple stages. This is useful in an analytical application where the J-T cooling effect resulting from a large pressure drop would cool a gas below its dew-point temperature, resulting in condensation of some components, which would distort the vapor composition.

BACKGROUND OF INVENTION

The heating value of natural gas has a significant impact on its monetary value. In general, the heating value of natural gas increases as the concentration of low volatility, high molecular weight components increases. Condensation of gas phase components, which reduce the proportion of high molecular weight components, therefore tends to decrease gas phase heating value, while vaporization of entrained liquid has the opposite effect.

In order for natural gas supply to keep up with demand over the next 10 to 20 years, it will be necessary to increase production from deep-water fields in the Gulf of Mexico. (Refer to Volume 1, Fall/Winter 1997 official newsletter of Colorado Engineering Experiment Station Inc.) Gas produced from said deep-water fields contains higher concentrations of low volatility components, such as water vapor and heavy hydrocarbons, and has a higher susceptibility to condensation than shelf and onshore production gas.

Additionally, some onshore produced gas, particularly in low ambient temperature regions, is susceptible to condensation of low volatility components. Condensation of low volatility components distorts the remaining vapor phase composition thereby changing its physical properties, heating value and monetary value.

The American Petroleum Institute (API) and the Gas Processors Association (GPA) are two leading industry organizations, having recommended standard practices for sampling and analysis of natural gas.

Both organizations require that the temperature of Natural gas samples be maintained above their hydrocarbon dew-point temperature. Most compositional analyzers require the sample gas pressure to be reduced substantially below the supply gas pressure. A gas pressure regulator is typically utilized for this purpose. In many cases, during pressure reduction, the J-T cooling effect cools the gas below its hydrocarbon dew-point temperature resulting in condensation of some low volatile components thereby altering its vapor phase composition and monetary value. This can be seen in the Phase diagram of FIG. 1.

Note that this particular gas composition, at the original source pressure, point "A" (2014.7 PSIA and temperature of 60° F.), all the components are in the gas phase. However after pressure reduction to 24.7 PSIA (point B) the J-T cooling effect has reduced the gas temperature to −27.9° F., which is well below its hydrocarbon dew-point temperature of −6.93° F. at that pressure. The sample gas at point B no longer conforms to the Industry standards and is no longer representative of the original source gas.

There are cases wherein Point B is in the gas phase, however the adiabatic or near adiabatic pressure drop line AB traverses the liquid phase envelope (2-Phase region) as seen in the Phase diagram of FIG. 2. When this occurs, the possibility exists for the transitional liquid formed to become separated from the gas phase, thereby causing compositional differences along a sample gas passageway.

It is possible, in some cases, to preheat the gas sufficiently to prevent it from traversing the 2-Phase region during pressure reduction. However it is not always safe or practical to preheat the gas sample to the required level.

An additional problem which occurs during pressure reduction and regulation of a high pressure gas is the instability of the secondary pressure or "set pressure". A common trait of single stage pressure regulators is that the secondary pressure is affected by changes in the primary or supply pressure. In many analytical applications, changes in the sample gas pressure feeding an analyzer has a negative impact on its accuracy.

Therefore it is advantageous to reduce high pressure natural gas sample sources in a manner which prevents condensation of some vapor phase components and provides a secondary pressure essentially independent of source pressure changes.

Further, it can be beneficial to reduce and regulate natural gas sample pressure internal to the pressure source. In such case, a flowing natural gas source, such as in a pipeline, can be utilized to maintain the sample gas at a near isothermal condition during pressure reduction. Refer to Mayeaux U.S. Pat. Nos. 7,004,041; 6,904,816; and 6,701,794.

However, as previously mentioned, there are cases wherein, at the initial and reduced pressure, the gas is totally in the gas phase but has traversed through the 2-Phase region, thereby subjecting it to distortion from condensation.

Insertion-type "probe regulators" such as described in Mayeaux U.S. Pat. Nos. 7,004,041; 6,904,816; and 6,701,794 (the contents of which are incorporated hereto by reference), employ a single stage of regulation. As previously mentioned, there are cases where a single stage of pressure reduction, providing essentially an adiabatic pressure drop, can result in distortion of the sample gas composition by cooling the gas below its hydrocarbon dew-point. Refer to FIG. 1.

Prior art multi-stage pressure regulators are bulky and typically limited to two stages. Further, the output pressure setting for stages upstream of the final stage in prior art systems are typically preset internally or externally adjustable for specific circumstances. The emphasis in prior art multi-stage regulators is on regulated pressure stability. Little or no consideration is give to minimizing the J-T cooling effect. Therefore prior art multi-stage pressure regulators designs do not address the major issues involved in the modern day sampling of Natural gas for compositional analysis.

FIG. 4 illustrates a typical two stage pressure regulator wherein with the first stage output set at 500 PSIG (which is typical) the J-T cooling effect is not distributed evenly between the two stages. Additionally, the actual J-T cooling effect distribution between the two stages varies significantly, and by reducing the gas pressure from 2014.7 to 514.7 in one stage at essentially adiabatic condition utilizing conventional methods, the gas is cooled sufficiently to penetrate the 2-Phase region, resulting in distortion of the a gas sample composition derived therefrom.

Accordingly, it is believed that the prior art has failed to provide a system to reduce and regulate a hydrocarbon sample gas stream pressure in a manner so as to prevent condensation from occurring during and after its transition from high to low pressure due to J-T cooling.

In addition, it is further believed that the prior art has failed to provide a method to regulate and maintain a constant and stable secondary pressure independent of variations of the primary (upstream supply pressure).

GENERAL SUMMARY OF INVENTION

Unlike prior art, the present invention provides for minimizing or eliminating the negative J-T cooling effect impact on Natural gas samples during pressure reduction and regulation. The present invention provides for reducing the pressure in each stage by a given ratio as opposed to a given pressure setting, as is the case with prior art. A ratio for each stage is selected to provide a somewhat uniform distribution of J-T effect cooling among each of the pressure reduction stages at a maximum expected input supply pressure. After each stage of pressure reduction the gas is reheated thereby preventing large temperature drops which could cause condensation of some hydrocarbons.

It has been discovered that by reducing the gas pressure of a typical natural gas composition by a given ratio for each pressure reduction stage, the J-T cooling effect can be distributed more evenly among said pressure reduction stages then proper art methods. An example is shown in FIG. 3. Wherein the pressure is reduced in each of the first three stages by a set ratio and the fourth stage output pressure is set to a specific pressure. It can be seen in FIG. 3 that at no time did the sample gas cross into the 2-Phase region (phase envelope) as had occurred with a single stage pressure drop seen in FIG. 1.

The transition cooling which takes place during pressure reduction at each stage is minimized in the multi-stage pressure reduction system of the present invention, as shown in FIG. 3, as opposed to the excessive J-T cooling shown in FIG. 4 utilizing the conventional two-stage regulator means, which can result in distortion of any sample derived therefrom.

In the present invention, a means for maintaining the input and output pressure of a stage at a given ratio is achieved by applying the input pressure to a first end of a piston disposed in a cylinder and applying the output pressure to the second end of said piston, said second end having a larger cross sectional area than the cross sectional area of said first end.

The ratio between the cross sectional areas of said first and second piston ends and a reference pressure determines the ratio between the input and output pressure of said stage. Said first and second ends of said piston are fluidly sealed to the internal wall of said cylinder. A region between the two said fluid seals is referenced to a given pressure herein after "reference pressure". Control of the output pressure to maintain the input/output stage ratio is achieved in the following manner. If the output pressure tends to rise above or fall below the set ratio the piston moves in a manner which changes the input gas flow to the stage until a balance is achieved.

In a preferred embodiment of the present invention applied to a four stage pressure regulator, the pressure in the first three stages is ratio controlled and the final (fourth) stage is set to control at a specific pressure. In this first preferred embodiment the pressure control ratio for each of the first three stages is applied to their input pressure measured in "gauge pressure" i.e. as referenced to atmospheric pressure. Therefore in some cases after three stages of ratio pressure reduction it is possible for the output of the third stage to be less then the required output pressure of the fourth adjustable pressure stage.

The minimum supply pressure input to the first stage must be sufficiently high so that after three stages of ratio control the pressure at the outlet of the third ratio stage is greater then the desired pressure setting of the fourth stage outlet.

In a preferred second embodiment of the present invention the "reference pressure" is equal to the last stage outlet pressure. In this case the last stage outlet pressure must be set to a specific value, i.e. it must not be a ratio pressure controlled stage.

By setting the "reference pressure" equal to the last stage outlet set pressure the first three stages divide the differential between the supply pressure and said last stage outlet pressure, thereby assuring that the output of the last ratio controlled stage (third stage in this case) is always higher then the desired fourth stage output pressure.

In a preferred third embodiment of the present invention one or more ratio pressure control stages are integrated into the tip of a sample probe pressure regulator. This negates the need for force transfer between an external pressure sensing diaphragm or piston and the pressure control valve internal to the process. This third preferred embodiment makes it possible to utilize multiple stages inside of a probe tip installed in a pressurized pipeline. As previously described the flowing source gas helps maintain the sample gas, which is undergoing pressure reduction, at a near isothermal condition.

Accordingly, the present invention provides a technique to reduce and regulate a hydrocarbon sample gas stream pressure in a manner which will prevent J-T condensation from occurring during and after its transition from high to low pressure. The present system also provides a system to regulate and maintain a constant and stable secondary (set) pressure essentially independent of variations in the primary (upstream supply) pressure. Further, as will be shown, both of these features can be accomplished utilizing a system internal to the source gas supply containment vessel or pipeline.

BRIEF DESCRIPTION OF THE FIGURES

For a further understanding of the nature and objects of the present invention, reference should be had to the following detailed description, taken in conjunction with the accompanying drawings, in which like parts are given like reference numerals, and wherein.

DETAILED DISCUSSION OF THE INVENTION

Figure 1:
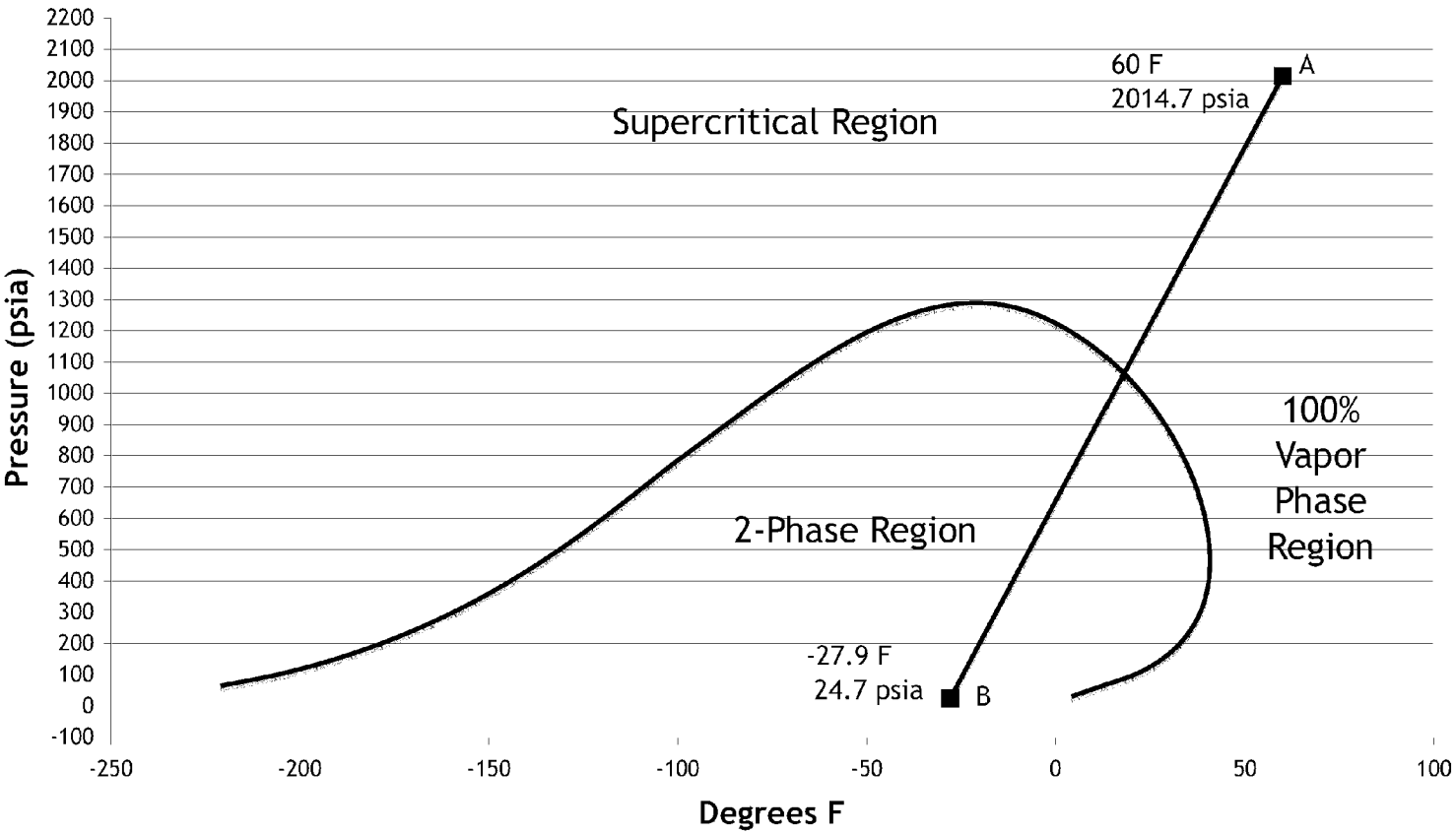
FIG. 1 is a phase change diagram illustrating the J-T cooling a sample gas from point A to below its hydrocarbon dew-point temperature (point B) resulting in condensation.
Figure 2:
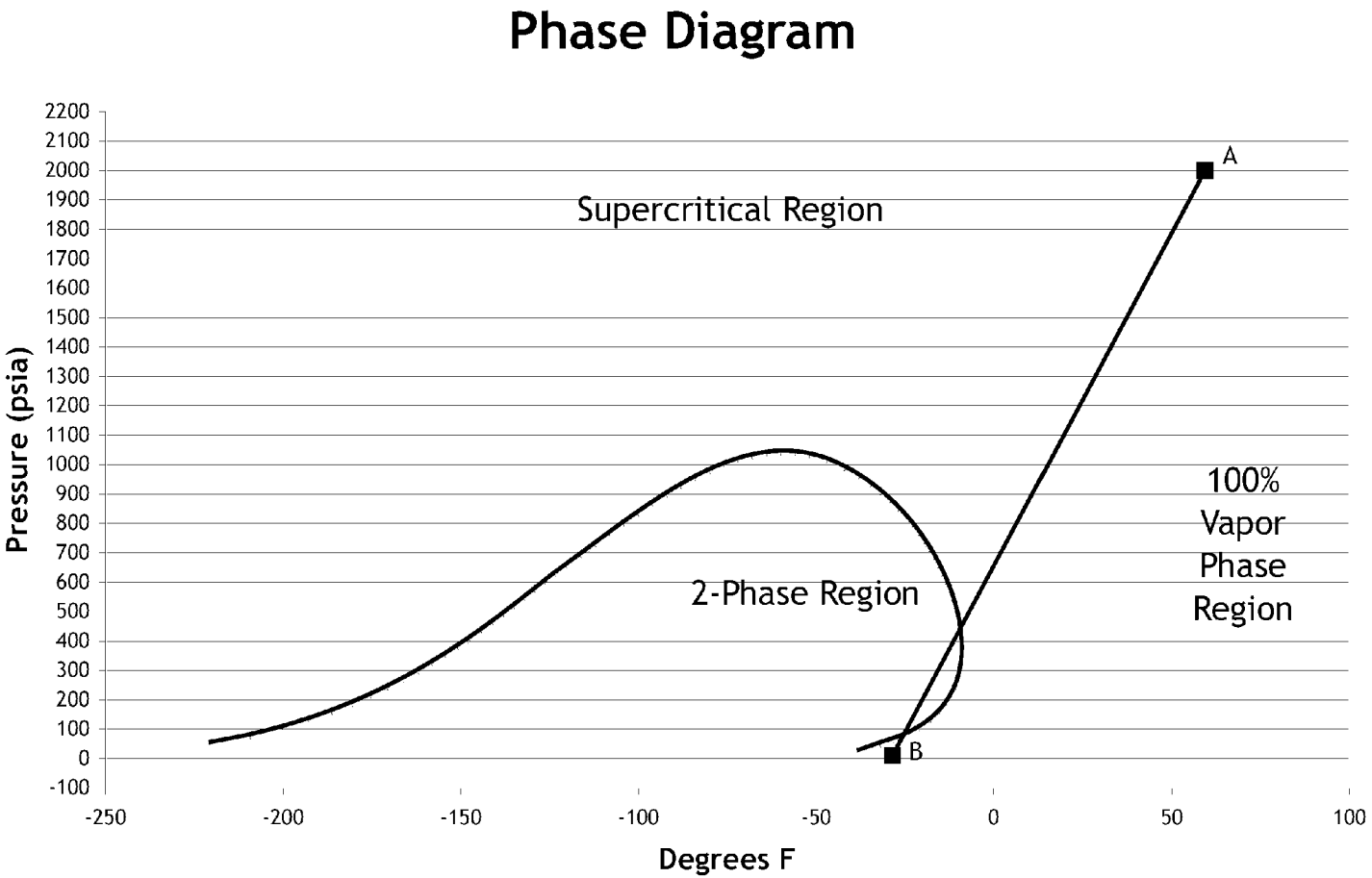
FIG. 2 is a phase change diagram illustrating point B is in the gas phase, however the adiabatic or near adiabatic pressure drop line AB traverses the liquid phase envelope (2-Phase region) resulting in the possibility of transitional liquid separating from the gas phase, which can cause compositional differences along a sample gas passageway.
Figure 3:
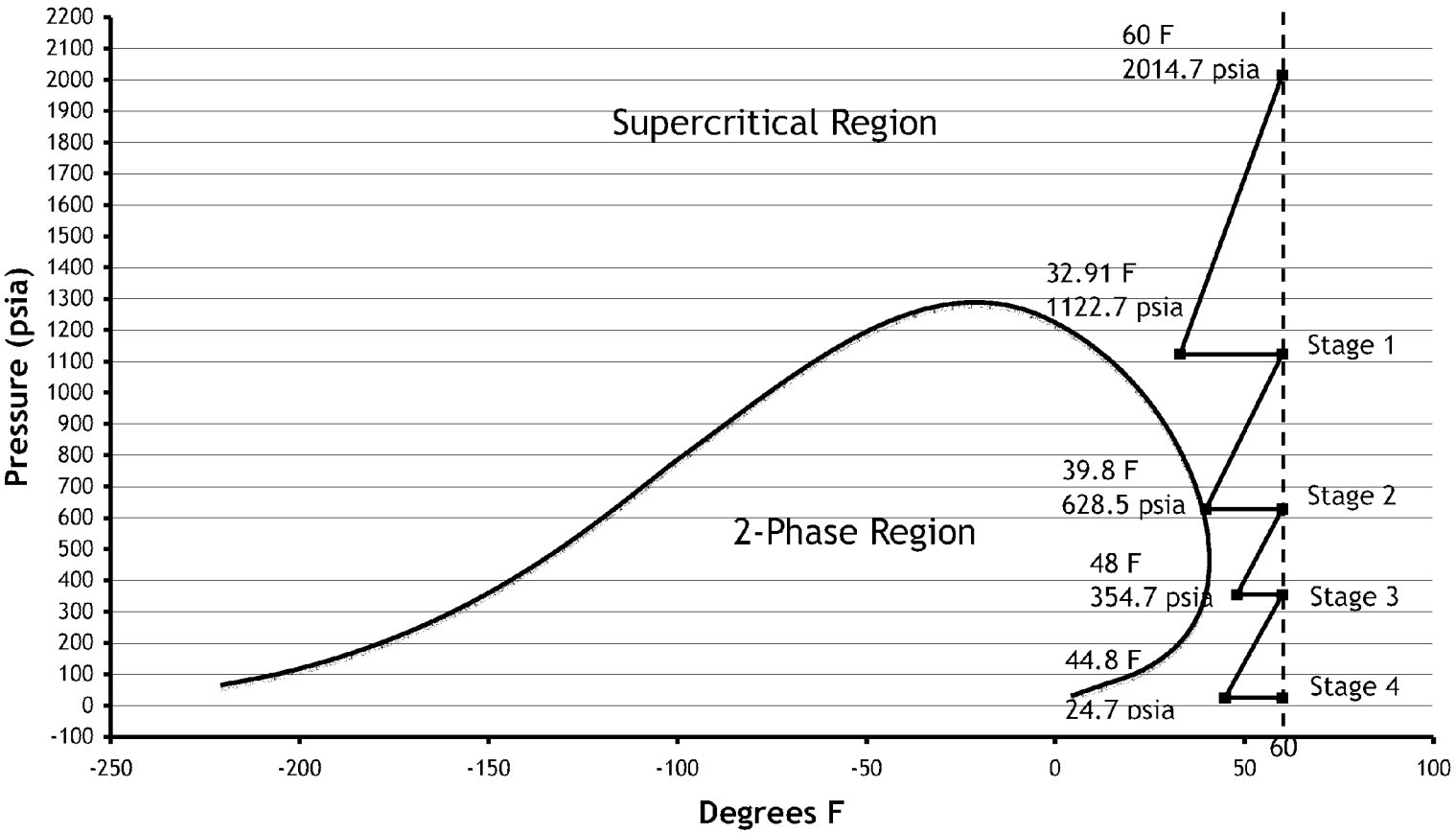
FIG. 3 is a phase change diagram illustrating a method of systematically reducing the pressure of a natural gas composition by a given ratio for each pressure reduction stage so as to distribute the J-T cooling effect so as to prevent condensation.
Figure 4:
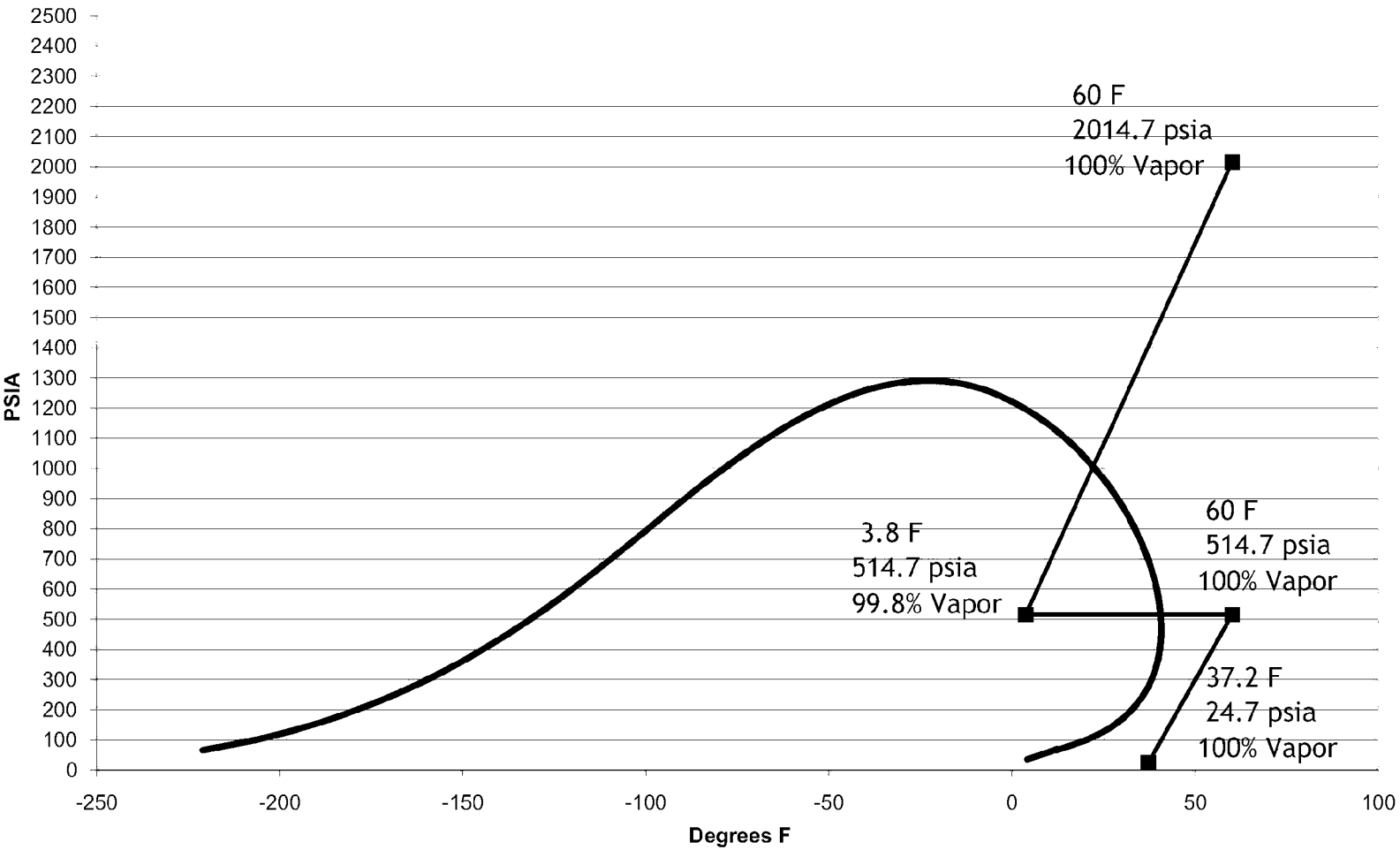
FIG. 4 is phase change diagram illustrating the excessive J-T cooling which can occur utilizing a conventional two-stage regulator to reduce the flow pressure of a gas stream, wherein the pressure/temperature drop line traverses the liquid phase envelope, which can result in distortion from any sample derived therefrom.
Figure 5:
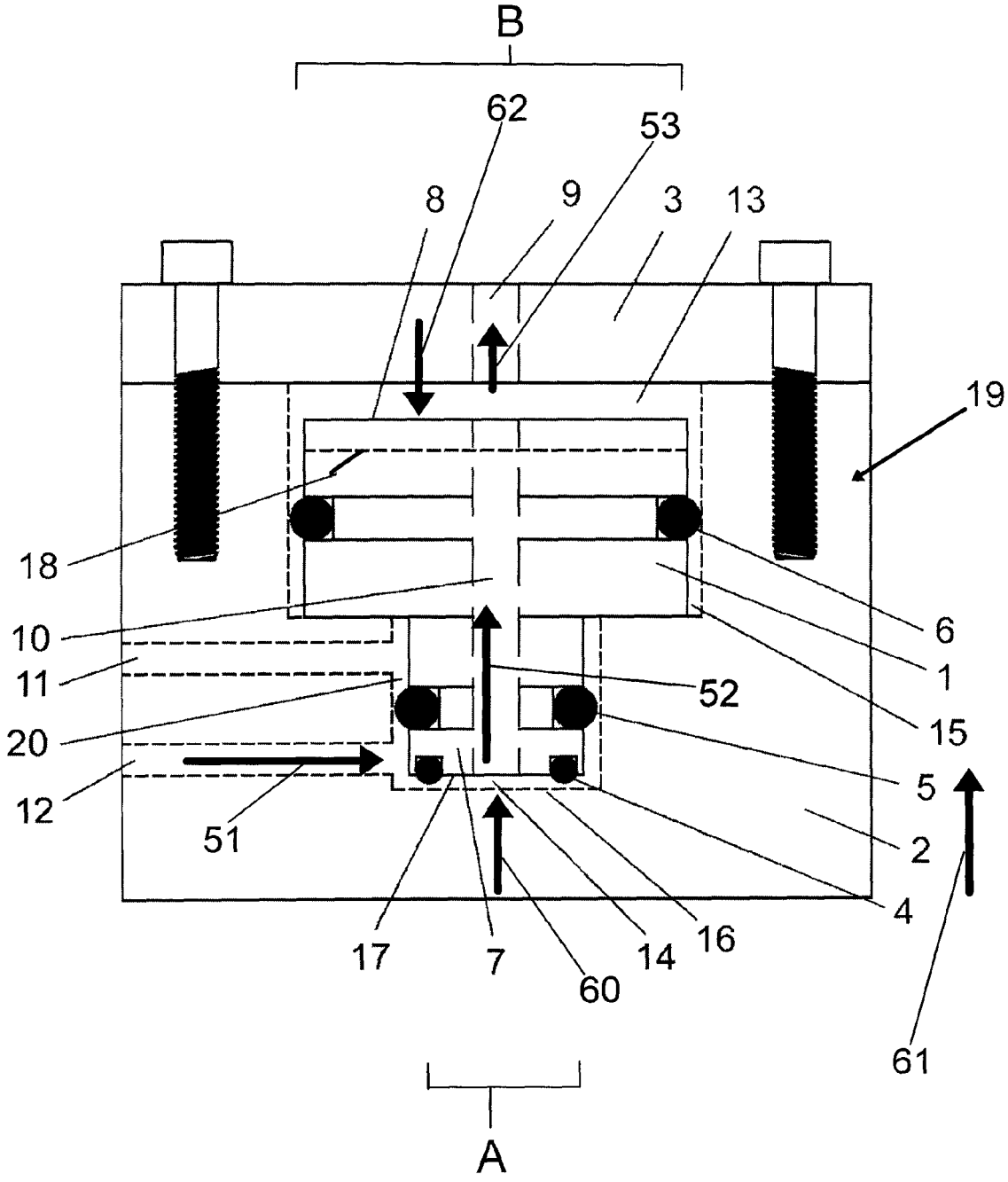
FIG. 5 is a side, cross-sectional view illustrating a first, preferred embodiment of the single stage pressure ratio regulator of the present invention.

Referring to FIG. 5, the first embodiment of the invention contemplates a single stage pressure ratio regulator 19 utilizing a piston 1 having a first end 7 and a second end 18, said piston 1 being disposed within cylinder cavity 15 in body 2. The area A of surface 17 at first piston end 7 is less then the area B of surface 8 of second piston end 18. A source of fluid at a given pressure level "A1" enters 51 inlet passage 12 and flows into lower cylinder cavity 14, through 52 piston passage 10, into upper cylinder cavity 13 and exits 53 through passage 9.

The fluid pressure at level "A1", in lower cylinder cavity 14, acts upon the area A of surface 17 to produce a force 60 against first piston end 7, said force urges piston 1 toward 61 cylinder cap 3. The fluid pressure at level "B1" in upper cylinder cavity 13 from the source fluid acts upon the area of surface 8 to produce a force 62 against second end 18, said force urges piston 1 away from cylinder cap 3. Since the area B of surface 8 is greater than the area A of surface 17, then force 62 is greater than force 60. When fluid pressure level "A1" and "B1" are equal, piston 1 is urged away from cylinder cap 3, thereby reducing the distance between surface 17 of piston end 7 and inner surface 16 of lower cylinder cavity 14.

As said distance is reduced, fluid flow entering piston passage 10 is throttled, which in turn results in a lowering of fluid pressure level "B1". This action causes piston 1 to settle in a position within cylinder cavity 15 wherein the throttling of fluid pressure level "B1" is such that force 62 is equal to force 60. As fluid pressure level "B1" tends to change as a result of changes in the flow rate of fluid exiting upper cylinder cavity 13 through passage 9, force 62 is changed in a manner which urges piston 1 to a position within cylinder cavity 15 wherein throttling of fluid entering piston passage 10 causes force 60 and 62 to become equal.

In a similar manner changes in fluid pressure level "A1" in lower cylinder cavity 14 results in repositioning of piston 1 such that throttling of fluid flow into piston passage 10 causes pressure level "B1" to change thereby changing force 62 in a direction and magnitude which restores the balance, or equality, of between force 60 and 62.

The result is that the pressure level "B1" is regulated in a manner which tends to maintain the ratio of pressure level "B1" to pressure level "A1" equal to the ratio of surface area B to surface area A.

In order for the single stage pressure ratio regulator 19 to operate properly, section 20 of cylinder cavity 15, must be fluidly isolated from lower cylinder cavity 14 and upper cylinder cavity 13. This is accomplished by fluid seals 5 and 6, respectively. The fluid pressure level "C" of section 20 of cylinder cavity 15 is referenced to an external fluid pressure by way of passage 11. When fluid pressure level "C" is referenced to atmospheric pressure then the gauge pressure (the absolute pressure plus 14.7 PSI) of the fluid source entering passage 12 will be reduced by a ratio equal to the ratio of area A of surface 17 to area B of surface 8.

In operation, when it is necessary to shut off fluid flow into passage 10 in order to prevent the pressure in upper cylinder cavity 13 from rising, fluid seal 4 is pressed against inner surface 16 by piston 1 movement away from cylinder cap 3, thereby effectively shutting off fluid flow into passage 10.

DEFINITION OF TERMS a) Pressure level "A1" ($PL_a$) is the absolute pressure in lower cylinder cavity 14 measured in PSIA
b) Pressure level "B1" ($PL_b$) is the absolute pressure in upper cylinder cavity 13 measured in PSIA
c) $F_a$ is the force resulting from applying fluid pressure to surface area A ($SA_a$)
d) $F_b$ is the force resulting from applying fluid pressure to surface area A ($SA_a$)
e) Surface area "A" ($SA_a$) is the square inches of surface area "A"
f) Surface area "B" ($SA_b$) is the square inches of surface area "B"
g) Reference pressure (RP) is the absolute pressure level "C" in section 20 of cylinder cavity 15 measured in PSIA
h) Pressure control ratio (PCR) is the ratio of surface area "A" to surface area "B" or A:B $PL_b$ for a given $PL_a$ and a given PCR is Calculated as Follows $$PL_b=[(PL_a-RP)PCR]+RP$$

Example

Given $PL_a$=114.7 PSIA
RP=14.7 PSIA
$SA_a$=1 square inch
$SA_b$=2 square inches
PCR=1 to 2 or ½ or 0.5

$$PL_b = [(PL_a - RP)PCR] + RP = [(114.7 - 14.7)0.5] + 14.7$$

$$= [(100)0.5] + 14.7 = 50 + 14.7 = 64.7$$

Force "A" ($F_a$) is the result of applying the differential pressure across fluid seal 5 to $SA_a$. In a similar manner Force "B" ($F_b$) results from applying the differential pressure across fluid seal 6 to $SA_b$.

Said differential pressures calculations require subtraction of the RP from $PL_a$ and $PL_b$. The net result is that the incoming fluid to a single stage pressure ratio regulator, at $PL_a$, is reduced by a specific ratio after first subtracting the RP. This is a very useful characteristic which allows pressure ratio control of a fluid only in a pressure range above the RP. Therefore, $PL_b$ can be made to remain above a given RP providing that $PL_a$ does not dip below said given PR.

For example, if in a given application, a minimum of 500 PSIA is required exit of passage 9 ($PL_b$). If an external RP of 500 PSIA is applied to section 20, the $PL_a$ is 2000, and the PCR is 0.5, then $PL_b$ would be 1250 PSIA.

$$\text{i.e. } PL_b = [(PL_a - RP)PCR] + RP = [(2000 - 500)0.5] + 500$$

$$= [(1500)0.5] + 500 = 750 + 500 = 1250 \ PSIA$$

In a second example if RP is 500 PSIA, $PL_a$ is 600 PSIA and PCR is 0.5 then $PL_b$ would be 550 PSIA.

$$\text{i.e. } PL_b = [(PL_a - RP)PCR] + RP = [(600 - 500)0.5] + 500$$

$$= [(100)0.5] + 500 = 50 + 500 = 550 \ PSIA$$

It can be seen from said example that only the portion of fluid pressure $PL_a$ greater than the RP is reduced by given ratio PCR.

Figure 6:
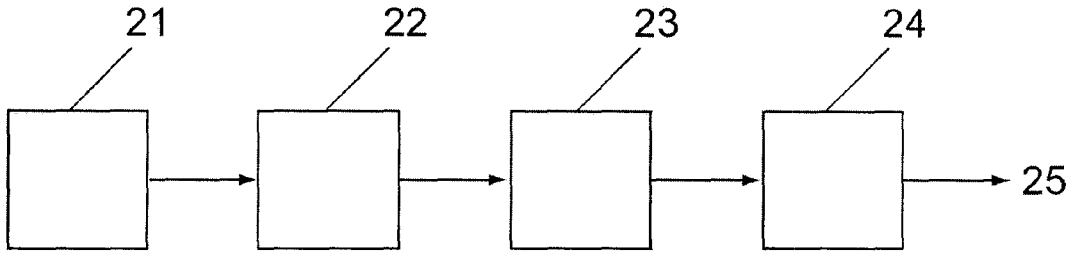
FIG. 6 is a schematic illustrating a second, preferred embodiment of the present invention, wherein there is shown plural stages of pressure ratio control in series so as to provide pressure ratio control.

A second preferred embodiment of the present invention, referring to FIG. 6, comprises multiple series stages of pressure ratio control. Fluid from fluid source 21 flows through first pressure ratio regulator stage 22, a second pressure ratio regulator stage 23, then third pressure ratio regulator stage 24, then exits from cylinder cap passage (9 in FIG. 5) of the third stage 24 to an external destination 25. Each of the pressure regulator stages can be in the form of a single stage pressure ratio regulator, as previously discussed.

Fluid pressure is reduced in each pressure ratio reduction stage in the manner previously described. Each of the said stages is independent in the sense that each one may have a different PCR or RP.

Figure 7:
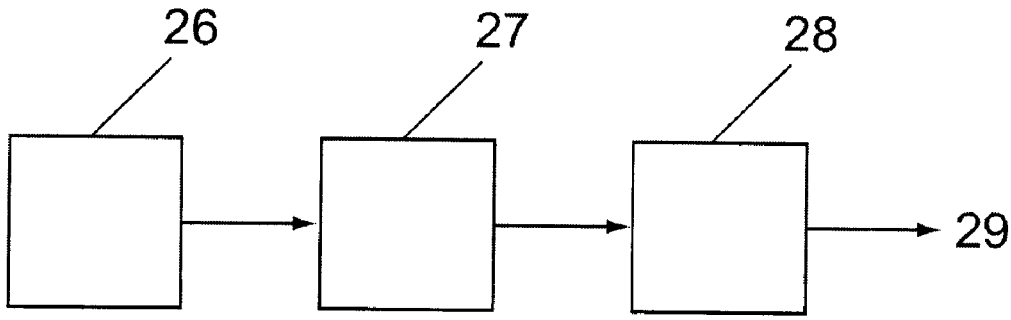
FIG. 7 is a schematic illustrating a third, preferred embodiment of the present invention wherein there is shown one or more stages of pressure ratio control followed by a final conventional adjustable pressure regulator stage.

A third preferred embodiment of the current invention, referring to FIG. 7, comprises one or more stages of pressure ratio control followed by a final conventional adjustable pressure regulator stage such as a diaphragm/load spring type of regulator. In such an arrangement fluid from source 26 flows into first stage pressure ratio regulator 27 then into adjustable pressure regulator stage 28 then flows to an external destination 29. This arrangement provides a simplified first pressure reduction stage 27 which assures that incoming fluid pressure $PL_a$ will be reduced before arriving at the adjustable pressure stage 28. This approach is beneficial for pressure control stability, and spreading the J-T cooling effect to prevent gas composition distortion.

Figure 8:
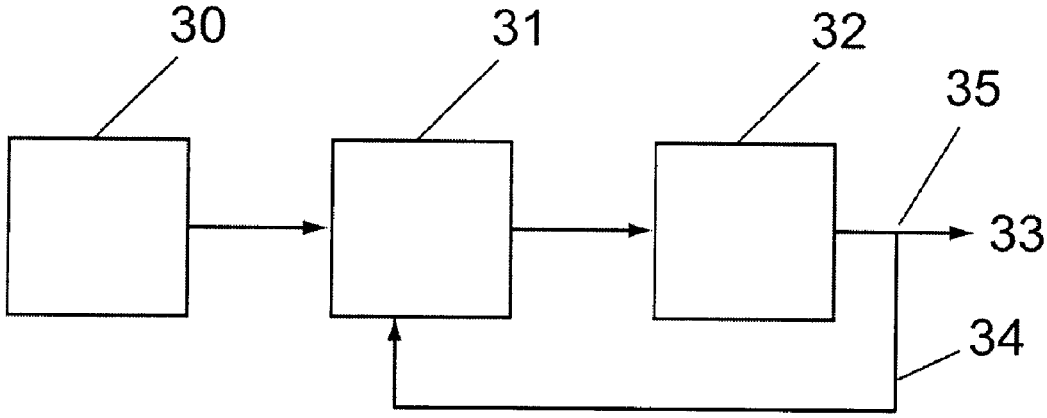
FIG. 8 is a schematic illustrating a fourth embodiment of the present invention, wherein there is shown one or more stages of pressure ratio regulation followed by a final conventional adjustable pressure regulator stage.

A fourth preferred embodiment of the current invention, refer to FIG. 8, consists of one or more stages of pressure ratio regulation followed by a final conventional adjustable pressure regulator stage such as a diaphragm/load spring type of pressure regulator. In such an arrangement fluid from fluid source 30 flows into first stage pressure ratio regulator 31 then into adjustable pressure regulator stage 32 then flows to an external destination 33. The outlet pressure from adjustable pressure 32 is taken at point 35 and supplied by a passage 34 to passage (11 in FIG. 5) of pressure ratio regulator stage 31 which then becomes the RP for said stage 31. This arrangement insures that the pressure of the source fluid will not be reduced below a desired minimum value providing that said desired value is equal to or lower than said pressure of the source fluid ($PL_a$). Said arrangement may also consist of multiple pressure ratio regulator stages.

Figure 9:
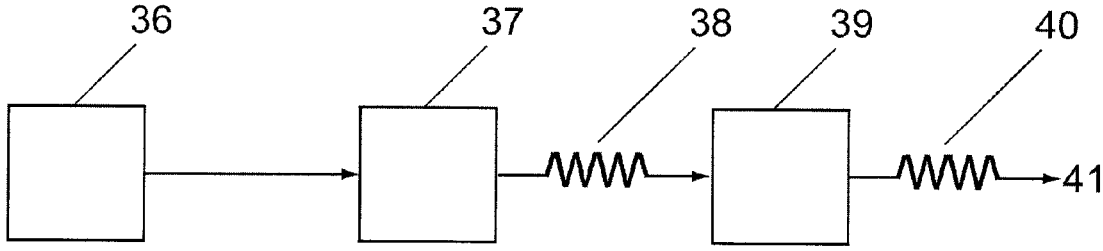
FIG. 9 is a schematic illustrating a fifth embodiment of the present invention, wherein there is shown the selective heating or cooling of the fluid after each pressure ratio regulation and adjustable regulation stage.

A fifth embodiment of the present invention consists of heating or cooling the fluid after each pressure ratio regulation and adjustable regulation stage, referring to FIG. 9. Fluid from fluid source 36 flows through pressure ratio regulator stage 37, through heat exchanger 38, through adjustable pressure regulator stage 39, through heat exchanger 40, then to an external destination 41, not shown. This approach can utilize multiple pressure ratio regulation and adjustable pressure regulation stages, each stage having a heat exchanger downstream of its outlet. The use of said multiple stages minimizes the pressure drop across each stage and therefore also minimizes the Joules-Thomson cooling effect across each stage.

What is claimed is:

1. A method for regulating the pressure of a fluid comprising the steps of:

a. providing a first pressure regulator, comprising a piston having first and second ends having unequal surface areas;

b. allowing a fluid to apply fluid pressure to said first and second ends of said piston, providing a force differential in the amount of force applied to said first and second piston ends due to their unequal surface areas;

c. utilizing said force differential to facilitate movement of said piston, so as to facilitate throttling of said fluid flow when the force exerted upon one end of said piston is greater than the force exerted by the other end of said piston; while d. providing a zone between the first and second ends of said piston which is referenced at a fluid reference pressure to influence said force differential applied to said first and second piston ends, and the resulting flow of fluid associated therewith;

e. providing a second pressure regulator in fluid communication with said first pressure regulator;

f. utilizing said second pressure regulator to provide regulated output; and g. utilizing said regulated output to produce said fluid reference pressure of step "d".

2. The method of claim 1 wherein there is further provided in step "b" of flowing said fluid between said first end and second end of said piston via a passage internal to said piston, and wherein, in step "d", said reference pressure in said zone between said first and second ends of said piston is provided to influence the flow of said fluid through said piston, so as to lessen the likelihood of Joules-Thomson cooling thereof.

3. The method of claim 1, wherein in step "e" said second pressure regulator is situated downstream from, and in series fluid communication with, said first pressure regulator.

4. The method of claim 3, wherein there is provide in step "e" the additional step "e1" of providing one or more pressure regulators in series fluid communication with, and situated intermediate to, said first pressure regulator and said second pressure regulator.

5. The method of claim 1 wherein, after step "e", there is further provided the step "e2" of thermally affecting said first pressure regulated fluid to lessen the likelihood of Joules-Thomson cooling thereof.

6. The method of claim 1, wherein in step "e", said second pressure regulator is of the diaphragm/load spring type.

7. A fluid pressure regulator system, comprising:

a first pressure regulator, comprising:

a piston disposed within a cylinder cavity, said piston having a first end and a second end, and wherein the surface area of said first piston end is different than the surface area of said second piston end so as to facilitate movement in said piston when equal fluid pressure is applied to both said first and second piston ends, first and second fluid seals spaced to form a fluid zone situated around said piston between said first and second piston ends, respectively;

a piston fluid passage providing fluid communication between said second piston end and said first piston end;

a fluid passage formed to admit fluid against said first piston end;

and a passage formed to facilitate the flow of fluid from said first piston end to said second piston end;

an adjustable a pressure regulator in series fluid communication with said first pressure regulator, said pressure regulator having an output in fluid communication with said fluid zone between said first and second piston ends of said first pressure regulator, so as to influence the operation thereof.

8. A method for regulating the pressure of a fluid comprising the steps of:

a. providing a first pressure regulator comprising:

i. a body having a cylinder cavity;

ii. a piston disposed within said cylinder cavity of said body, said piston having a first end and a second end each having a surface area, said surface area of said first piston end being unequal in size to said surface area of said second piston end;

iii. a first fluid passage associated with said body for admitting fluid against said first piston end;

iv. said piston having formed therethrough a piston flow passage for fluid to flow from said first piston end to second piston end;

v. a first fluid seal around said piston situated in the vicinity of said first piston end and a second fluid seal around said piston situated toward said second piston end, so as to form a fluid zone therebetween;

b. allowing fluid to flow, via said first fluid passage, to said first end of said piston, so as to apply fluid pressure to said first end of said piston;

c. flowing fluid through said piston fluid passage formed through said piston from said first end of said piston to said second end of said piston, so as to apply fluid pressure to said second end of said piston;

d. allowing fluid pressure applied to said greater surface area of said second piston end to form an unbalance of forces resulting from the application of fluid pressure to said first and second piston ends having unequal surface areas;

e. regulating the fluid flow via said fluid pressure applied to said first and second piston ends having unequal areas so as to reposition said piston such that throttling of the flow of said fluid is increased when the force exerted by one end of said piston is greater than the force exerted by the other end of said piston, providing regulated fluid flow;

f. providing a reference pressure in said fluid zone to influence the flow of fluid through said piston;

g. providing an second pressure regulator downstream said first pressure regulator in series relationship;

h. flowing said regulated fluid flow from said first pressure regulator to said second pressure regulator, so as to provide regulated pressure fluid; and i. utilizing said regulated pressure fluid as said reference pressure of step "f,".

9. The method of claim 8, wherein said second regulator is adjustable.

10. The method of claim 9, wherein there is provided in step "e," the additional step "el," of thermally affecting said regulated fluid flow so as to prevent Joules-Thomson cooling thereof.

11. The method of claim 8, wherein after step "f," there is provided the additional step "fi" of providing a heat exchanger to engage said fluid flowing from said first pressure regulator to said second fluid pressure regulator, and step "fii" of utilizing said heat exchanger to thermally effect said fluid flowing from said first pressure regulator to said second fluid pressure regulator, so as to minimize Joules-Thomson cooling.

12. The method of claim 9, wherein after step 37 f," there is provided the additional step "fi" of providing a heat exchanger to engage said fluid flowing from said first pressure regulator to said adjustable pressure regulator, and step "fii" of utilizing said heat exchanger to thermally effect said fluid flowing from said first pressure regulator to said adjustable pressure regulator, so as to minimize Joules-Thomson cooling.

13. The method of claim 8, wherein in step "aii" said second piston end has a greater surface area than said first piston end, and wherein in step "e" said fluid pressure is applied to said first and second piston ends such that said second piston end, having greater surface area than said first piston end, receiving a greater application of force from said fluid pressure so as to reposition said piston throttle said fluid flow, providing said regulated fluid flow.

14. The method of claim 8, wherein there is provide after step "g," the additional step "g1," of providing one or more pressure regulators in series fluid communication with, and situated intermediate to, said first pressure regulator and said second pressure regulator.

* * * * *